United States Patent [19]

Woodard

[11] Patent Number: 4,557,227

[45] Date of Patent: Dec. 10, 1985

[54] EXHAUST PORT BRIDGE RELIEF HOLE

[75] Inventor: Robert W. Woodard, Waukegan, Ill.

[73] Assignee: Outboard Marine Corporation, Waukegan, Ill.

[21] Appl. No.: 608,905

[22] Filed: May 10, 1984

[51] Int. Cl.[4] ..... F02F 1/22

[52] U.S. Cl. ..... 123/65 PE; 123/193 C; 92/71; 92/1

[58] Field of Search ..... 123/65 PE, 65 P, 41.84, 123/193 C, 193 CH, 193 R; 92/171, 1

[56] References Cited

U.S. PATENT DOCUMENTS

| | | | |
|---|---|---|---|
| 653,379 | 7/1900 | Daellenbach | 123/65 PE |
| 1,514,476 | 11/1924 | Still | 123/65 PE |
| 4,121,552 | 10/1978 | Mithuo et al. | 123/65 PE |

FOREIGN PATENT DOCUMENTS

| | | | |
|---|---|---|---|
| 73124 | 9/1951 | Denmark | 123/65 P |
| 518 | 1/1981 | Japan | 123/193 C |

*Primary Examiner*—Ira S. Lazarus
*Assistant Examiner*—R. S. Bailey
*Attorney, Agent, or Firm*—Michael, Best & Friedrich

[57] ABSTRACT

An internal combustion engine cylinder liner adapted to have a piston move reciprocally therewithin, the cylinder liner including an exhaust port, an exhaust port bridge extending across the exhaust port, and a relief hole in the cylinder liner positioned at one end of the exhaust port bridge for allowing the exhaust port bridge to expand in a direction other than toward the path of piston movement.

11 Claims, 3 Drawing Figures

EXHAUST PORT BRIDGE RELIEF HOLE

BACKGROUND OF THE INVENTION

The invention relates to exhaust ports in 2-cycle engine cylinders, and more particularly to bridged exhaust ports.

Bridged exhaust ports are used to allow the total width of the exhaust port to be greater than what would be allowable with a single exhaust port. A potential problem with some bridged exhaust ports is that if the bridge is too thin, or if the temperature of the bridge becomes too high, the bridge may deform inwardly into the path of piston movement. This deformation would put a high loading on both the piston and the piston rings.

SUMMARY OF THE INVENTION

The invention provides an internal combustion engine cylinder liner adapted to have a piston move reciprocally therewithin, the cylinder liner including an exhaust port, an exhaust port bridge extending across the exhaust port, and means for allowing the exhaust port bridge to expand in a direction other than toward the path of piston movement.

The invention also provides an internal combustion engine cylinder adapted to have a piston move reciprocally therewithin, the cylinder including an exhaust port, a exhaust port bridge extending across the exhaust port, and means for allowing the exhaust port bridge to expand in a direction other than toward the path of piston movement.

In one embodiment, the means for allowing the exhaust port bridge to expand in a direction other than toward the path of piston movement includes a relief hole in the cylinder liner positioned at one end of the exhaust port bridge.

In one embodiment, the piston includes a piston ring, and the relief hole is positioned outside of the range of piston ring movement within the cylinder.

In one embodiment, the exhaust port bridge extends vertically, and the relief hole is positioned below the exhaust port bridge.

A principal feature of the invention is that it allows the exhaust port bridge to expand due to temperature rise without extending into the path of piston movement.

Another principal feature of the invention is that the relief hole can be located below piston ring travel, so that it cannot interfere with piston movement.

Other features and advantages of the invention will become apparent to those skilled in the art upon review of the following detailed description, claims, and drawings.

Figure 1:
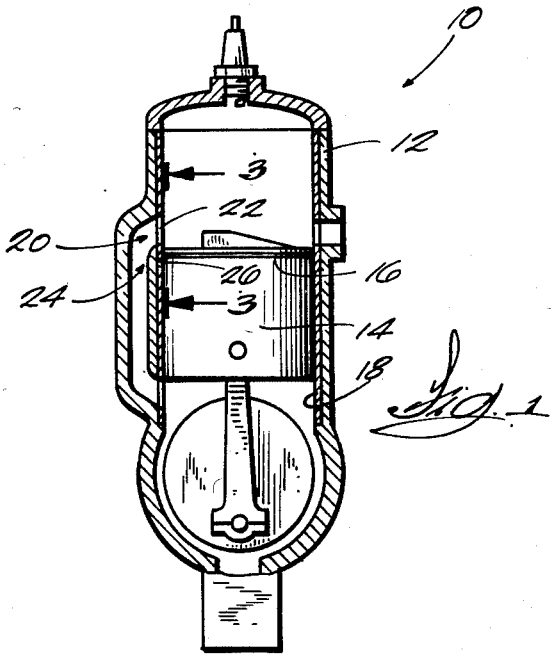
FIG. 1 is a cross-sectional view of an internal combustion engine embodying the invention.

Before explaining one embodiment of the invention in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 3:
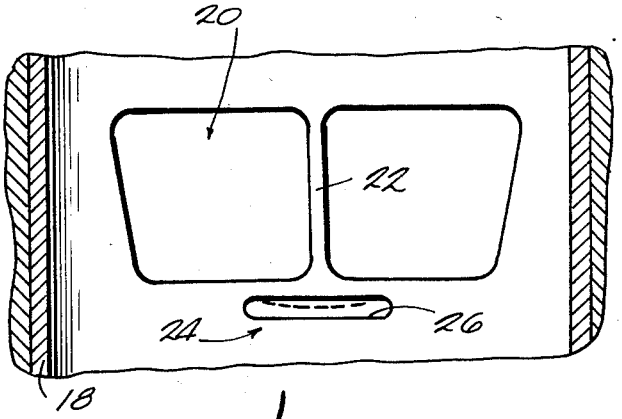
FIG. 3 is a cross-sectional view taken along line 3—3 in FIG. 1.

Illustrated in FIG. 1 is an internal combustion engine 10 which includes a cylinder 12 and a piston 14 which moves reciprocally upwardly and downwardly within the cylinder 12. The piston 14 includes a piston ring 16, and the cylinder 12 includes a cylinder liner 18 including an exhaust port 20. The exhaust port 20 is a conventional bridged exhaust port including an exhaust port bridge 22, as best shown in FIG. 3.

If the exhaust port bridge 22 is too thin or if the temperature of the exhaust port bridge 22 becomes to high, there is a possibility that the exhaust port bridge 22 will deform inwardly into the path of piston movement, thereby putting a high loading on both piston 14 and the piston ring 16 when the piston 14 moves past the exhaust port 20.

As shown in the drawings, the cylinder liner 18 includes means 24 for allowing the exhaust port bridge 22 to expand in a direction other than toward the path of piston movement. While various suitable means could be employed for this purpose, in the illustrated construction, this means 24 includes a relief hole 26 in the cylinder liner 18 positioned at one end of the exhaust port bridge 22. In the preferred embodiment, the relief hole 26 is a blind hole in the cylinder liner 18 located directly below the exhaust port bridge 22, as best shown in FIGS. 2 and 3.

Figure 2:
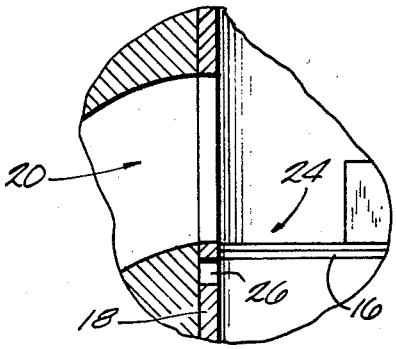
FIG. 2 is an enlarged partial cross-sectional view of the cylinder liner and piston of FIG. 1.

As illustrated in FIGS. 1 and 2, the relief hole 26 preferably is also located below the lowest point of the piston ring travel, so that it will not interfere with the movement of the piston ring 16.

It should be noted that the shape of the relief hole 26 is not critical, although the elongated shape shown in FIG. 3 is believed to be preferable.

In operation, when the exhaust port bridge 22 expands due to an increase in temperature, the bridge 22 will take the path of least resistance and expand downwardly into the relief hole 26, as shown by the dotted line in FIG. 3, since greater resistance is offered by the piston 14 and piston ring 16 if the bridge 22 expands inwardly into the cylinder 12. Therefore, the relief hole 26 will essentially eliminate undesired loading on the piston ring 16 and/or the piston 14 caused by expansion of the exhaust port bridge 22 inwardly into the cylinder 12.

Various of the features of the invention are set forth in the following claims.

I claim:

1. An internal combustion engine including a cylinder which has a liner and which is adapted to receive a piston for reciprocal movement within said cylinder liner, said cylinder liner including an exhaust port, an exhaust port bridge extending across said exhaust port, and means for allowing said exhaust port bridge to expand in a direction other than toward the path of piston movement, said means including a relief hole extending only through said cylinder liner near said exhaust port bridge.

2. An internal combustion engine cylinder as set forth in claim 1 wherein the piston includes a piston ring, and wherein said relief hole is positioned outside of the range of piston ring movement within said cylinder liner.

3. An internal combustion engine cylinder as set forth in claim 2 wherein said exhaust port bridge extends vertically, and wherein said relief hole is positioned below said exhaust port bridge.

4. An internal combustion engine cylinder as set forth in claim 3 wherein said relief hole is positioned below the lowest point of piston ring movement within said cylinder liner.

5. A cylinder liner for an internal combustion engine, said cylinder liner being adapted to receive therein a reciprocally moveable piston, said cylinder liner including an exhaust port, an exhaust port bridge extending across said exhaust port, and means for allowing said exhaust port bridge to expand in a direction other than toward the path of piston movement, said means including a relief hole extending through said cylinder liner near said exhaust port bridge.

6. A cylinder liner as set forth in claim 5 wherein the piston includes a piston ring, and wherein said relief hole is positioned outside of the range of piston ring movement within said cylinder liner.

7. A cylinder liner as set forth in claim 6 wherein said exhaust port bridge extends vertically, and wherein said relief hole is positioned below said exhaust port bridge.

8. A cylinder liner as set forth in claim 7 wherein said relief hole is positioned below the lowest point of piston ring movement within said cylinder liner.

9. An internal combustion engine cylinder adapted to receive a piston including a piston ring for reciprocal movement therewithin, said cylinder including an exhaust port, an exhaust port bridge extending across said exhaust port, and means for allowing said exhaust port bridge to expand in a direction other than toward the path of piston movement, said means including a relief hole in said cylinder positioned near said exhaust port bridge at a location outside of the range of piston ring movement within said cylinder.

10. An internal combustion engine cylinder as set forth in claim 9 wherein said exhaust port bridge extends vertically, and wherein said relief hole is positioned directly below said exhaust port bridge.

11. An internal combustion engine cylinder as set forth in claim 10 wherein said relief hole is positioned below the lowest point of piston ring movement within said cylinder.

* * * * *